US010480241B1

(12) United States Patent
Jude

(10) Patent No.: US 10,480,241 B1
(45) **Date of Patent: *Nov. 19, 2019**

(54) DOORS INCLUDING CUSTOMIZABLE AND REMOVABLE STORAGE

(71) Applicant: Kustom Doors LLC, Beaver, WV (US)

(72) Inventor: Terry Mike Jude, Beaver, WV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/513,754

(22) Filed: Jul. 17, 2019

Related U.S. Application Data

(63) Continuation-in-part of application No. 15/827,454, filed on Nov. 30, 2017.

(60) Provisional application No. 62/454,319, filed on Feb. 3, 2017.

(51) Int. Cl.

| | |
|---|---|
| ***A47B 67/02*** | (2006.01) |
| ***E06B 3/70*** | (2006.01) |
| ***E06B 7/28*** | (2006.01) |
| ***E05D 5/02*** | (2006.01) |

(52) U.S. Cl.
CPC ..... *E06B 3/70* (2013.01); *E05D 5/0276* (2013.01); *E06B 7/28* (2013.01); *E06B 2003/7011* (2013.01); *E06B 2003/7049* (2013.01)

(58) Field of Classification Search
CPC ..... E06B 7/34
USPC ..... 312/242, 246, 248, 321.5
See application file for complete search history.

(56) References Cited

U.S. PATENT DOCUMENTS

| | | | | |
|---|---|---|---|---|
| 1,980,730 | A | 11/1934 | Matchette | |
| 2,200,934 | A | 5/1940 | Platt et al. | |
| 3,822,925 | A | 7/1974 | Osroff | |
| 3,997,220 | A | 12/1976 | Mayer | |
| 4,076,350 | A | 2/1978 | Crist | |
| 5,163,745 | A | 11/1992 | Zagata | |
| 5,720,547 | A * | 2/1998 | Baird | A47B 77/16 220/552 |
| 8,713,857 | B2 | 5/2014 | Logue | |
| 8,864,636 | B1 | 10/2014 | Danowski et al. | |
| 2006/0112741 | A1 | 6/2006 | Engel | |
| 2010/0132895 | A1 | 6/2010 | Logue | |
| 2010/0293861 | A1 | 11/2010 | Ting et al. | |
| 2012/0067090 | A1 | 3/2012 | Varney et al. | |
| 2012/0146470 | A1 | 6/2012 | Katz et al. | |
| 2012/0223626 | A1 | 9/2012 | Thomas | |
| 2012/0280605 | A1 | 11/2012 | Nettles et al. | |
| 2013/0192318 | A1 | 8/2013 | Yanar et al. | |

* cited by examiner

*Primary Examiner* — Matthew W Ing
(74) *Attorney, Agent, or Firm* — Dinsmore & Shohl LLP; Monika L'Orsa Jaensson, Esq.

(57) ABSTRACT

A modular insert useful for storing one or more objects, designed and configured to inset within a door having one or more cavities. The modular insert includes a frame having a plurality of walls and a top panel movably affixed to the frame or the door. Some of the walls may have apertures to facilitate securing the modular insert to an interior support structure of the door. Also provided is a door suitable for receiving one or more modular inserts, the door having one or more cavities to receive and support the modular inserts.

15 Claims, 19 Drawing Sheets

DOORS INCLUDING CUSTOMIZABLE AND REMOVABLE STORAGE

BACKGROUND

The disclosed technology provides a modular insert useful for storing one or more objects, designed and configured to inset within a door having one or more cavities. The disclosed technology further regards a door suitable for mounting the modular inserts of the disclosed technology.

Keeping secrets has been a fascination of humankind since the beginning of time. The desire to hide objects securely has led to numerous creative methods of storage. Egyptians for example, created hidden compartments through the structure of pyramids. In modern time, locked safes are used to protect valuable contents from theft, potential damage, or other threats. Household safes are sometimes integrated into interior and exterior walls, often concealed.

Furthermore, the use of in-wall installations of bookshelves and other storage areas allows users to maximize the empty space between walls, and storage rooms are not uncommon. In households with limited space, people often support objects in hanging arrangement on the back of a cabinet, closet or other door, which maintains the look and integrity of the door.

While many storage methods have been developed to maximize the space behind doors, the space available inside the door is sometimes overlooked. Therefore, there is a need for concealed storage utilizing the space within doors, while maintaining the beauty of the door panels.

The disclosed technology provides for a flexible design wherein a plurality of removable and interchangeable modular inserts, customizable with or without support structures for supporting and securing items therein, are provided for inset into a door. The disclosed technology further provides for a door suitable for receiving and supporting these modular inserts.

GENERAL DESCRIPTION

The disclosed technology provides a modular insert useful for storing one or more objects. Generally, the modular insert includes a frame having a plurality of walls forming a plurality of sides of the frame. The frame further includes a top panel movably affixed to the frame.

The modular insert is designed and configured to inset within a door having one or more cavities, the cavities being defined by a plurality of stiles and rails. The door may be made of solid wood, engineered wood such as, without limitation, medium-density fiberboard (MDF), metal, and other materials. In some embodiments, at least two of the modular insert walls have apertures to receive affixation means (e.g., wing nuts, screws, bolts, quick release or push-pull pins) so that the modular insert may be removably secured within the door cavity. In some embodiments the insert has a depth equal to a depth of the stiles and rails of the door defining the cavity; in other embodiments the insert has a lesser depth than the door depth.

In some embodiments, as hereinafter described, the modular insert has a base panel, and the walls of the frame are secured about a perimeter of the interior surface of the base panel; the exterior surface of the base panel may form the exterior of one side of the door, at the cavity, and may be made from or include a layer of material that is the same material as the door, for example the same timber species as a door, or may be made from a different material (or timber species).

The top panel of the modular insert of the disclosed technology may be hingedly affixed to a first side of the frame by, for example, one or more hinges comprising a pair of plates, wherein one of the plates may be secured to a first interior side of the frame, and the other plate is affixed to an interior side of the top panel by means of a block. In some embodiments, the frame comprises a recess along the length of the first side to accommodate the hinge of the modular insert, so that the top panel may be easily opened and closed, and when closed the exterior surface of the top panel is flush with the corresponding door surfaces. In some embodiments, the hinging mechanism is spring loaded to encourage the top panel into its closed position relative to the frame, until opened by a user.

The top panel of the modular insert may have two distinct panels, with the first panel hingedly secured on one side to a first frame wall, and the second panel hingedly secured on one side to a second frame wall, opposing the first frame wall. The top panel (and the base panel, if any) may be sized about ¼" to 1" in length and width greater than the corresponding dimensions of the frame. In these and other embodiments, each of the frame walls may further include a frame segment, extending from a front face of each said wall into the vacuous area formed by the frame walls, and the top panel(s) is(are) hingedly affixed to one of the frame segments.

In some embodiments, the top panel may include a magnet on an interior surface thereof, the magnet having a magnetic field to attract and removably secure a magnet knob when positioned on an exterior surface of the top panel.

Other securing means may be integrated into the modular insert of the disclosed technology to secure the contents within the insert. For example, an actuator electrically engaged with a power supply may lock the top panel to the frame, until the actuator receives a signal to release the lock. The actuator may be controlled by, for example, a remote control, or may be controlled by known means for recognizing an owner, such as gesture recognition, biometric recognition and fingerprint recognition.

Various support structures may be affixed to the frame of the modular insert (or to the back panel, if any), to support one or more of the objects in the modular insert. Support structures suitable for use in the disclosed technology include shelves, hooks, adornment holders, individual storage compartment, rods, tie racks, and combinations thereof.

The modular insert and its support structures may be manufactured from any of a plurality of materials, including plastic, wood, metal or polyesters.

The disclosed technology further regards a door suitable for mounting a modular insert as hereinabove and hereinafter described. The door has a plurality of stiles and rails to form one or more cavities. In this arrangement, the modular inserts are sized and configured to be received in one of the cavities of the door. In some embodiments of the door, the modular inserts are intended to provide both front and back panels to the door, at the cavities; in other embodiments of the door, the door has a fixed panel on one side of the door or at each cavity, and the modular inserts provide the second panel on the opposing side of the door.

The cavities of the door may have an internal mounting structure affixed to the stiles and rails forming the cavity, where the mounting structure has a reduced depth from the depth of the stiles and rails. This reduced depth may be equal to the thickness of the top panel, or when a base panel is present, the combined thickness of the top and base panels (wherein the mounting structure is centrally positioned within the depth of the cavity).

The disclosed technology further regards a door suitable for mounting a plurality of modular inserts. The door has a plurality of cavities on a first side, with a top panel affixed to the first side of the door to cover each cavity. A plurality of modular inserts are removably received and secured within each of the cavities of the door.

DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
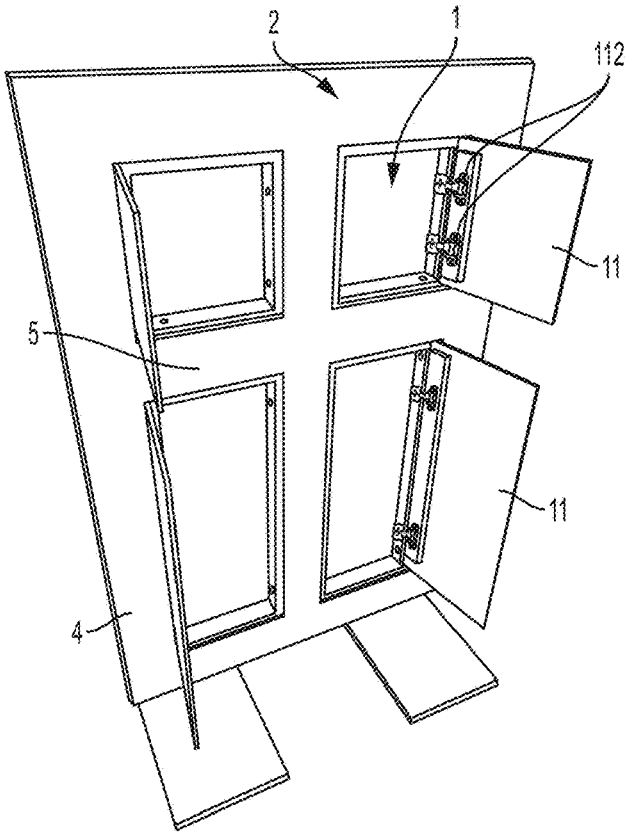
FIG. 1 is front view of an embodiment of the door of the disclosed technology, with modular inserts installed and front panels in the open position.

As shown in FIGS. 1-16, embodiments of the disclosed technology include a modular insert 1 designed and configured to inset within a door 2 having one or more cavities 3 defined by a plurality of stiles 4 and rails 5, wherein the modular insert is sized and configured to be received and removably secured within the cavity. The door has hinges to affix to a door frame, and may be made of solid wood, engineered wood such as MDF, or other materials. The door may be manufactured from multiple pieces of material, independently forming the stiles and rails and the various components of the door when joined, or the stiles and rails and other components, or some of them, may be formed as a single piece of material, by using materials such as MDF.

In some embodiments, the insert may have a depth equal to the depth of the stiles and rails so that the exterior panels 11, 12 thereof sit flush with the stiles and rails of the door, although the depth may also vary from the depth of the stiles and rails, to provide additional storage or for architectural design. The modular insert, as hereinafter described, may be useful for storing one or more objects.

In an embodiment of the disclosed technology, as shown in FIGS. 6-10, the modular insert 1 includes a frame 10 having a plurality of walls 110 forming a plurality of sides of the frame. Hingedly affixed on a first side 111 of the frame is a top panel 11, the top panel movable between an open and a closed position. In some embodiments the modular insert also has a base panel 12, wherein the walls of the frame are secured, by adhesive, staples or other means of affixation, about a perimeter of the interior surface of the base panel. When installed in a door having a void cavity, the back surface of this base panel becomes the exterior panel of the door, and may be made in the same material (e.g., timber species), or a different material, as the door. Other embodiments may not have a base panel, or the base panel may not become the exterior of the door, in which embodiments the door has one or more back panels, covering the back of the cavity. In these and other embodiments, the cavity may further have an internal frame 22 affixed to the stiles and rails (see, e.g., FIGS. 4 and 5), the internal frame having a reduced depth, wherein the reduction in depth is equal to the thickness of the top panel. In such configurations, as shown in FIG. 5 the top panel may be removed from the modular insert when it is being inset within the door, and movably affixed when the insert is fully inset with the door.

The top panel 11 of the embodiments shown in FIGS. 1, 2, and 6-11, is hingedly affixed to a first side of the frame by means of one or more hinges 112, each hinge comprising a pair of plates 113, 114, with the first plate 113 affixed to an interior surface of a frame wall, and the second plate 114 affixed to the top panel, the second plate swiveling about the first plate by means of the hinge pin or similar hinge mechanism. Hinges useful in the disclosed technology include butt, barrel, knuckle, gravity pivot and spring hinges. In the embodiment shown in FIGS. 6-10, a spring hinge is used to maintain the top panel secured in a closed position until opened by the user, and the second plate is secured to the top panel by means of a block 115, secured to an interior side of the top panel.

In other embodiments (not shown), the top panel is slidably engaged with the frame, wherein the frame and the top panel have corresponding rails to facilitate sliding engagement of the top panel relative to the frame. In some of these embodiments, the modular insert is removed from the cavity of the door prior to removing the top panel.

In some embodiments, such as those depicted in in FIGS. 6-11, the top panel is sized larger (about ¼" to 1") in length and width as compared to the dimensions of the frame. In these embodiments, when the modular insert has a base panel and the modular insert is intended to be inset into a void cavity of the door, the top and base panels are sized to be received within the door cavity. This embodiment of the disclosed technology works well when the door has an internal frame, as hereinabove described.

Figure 2:
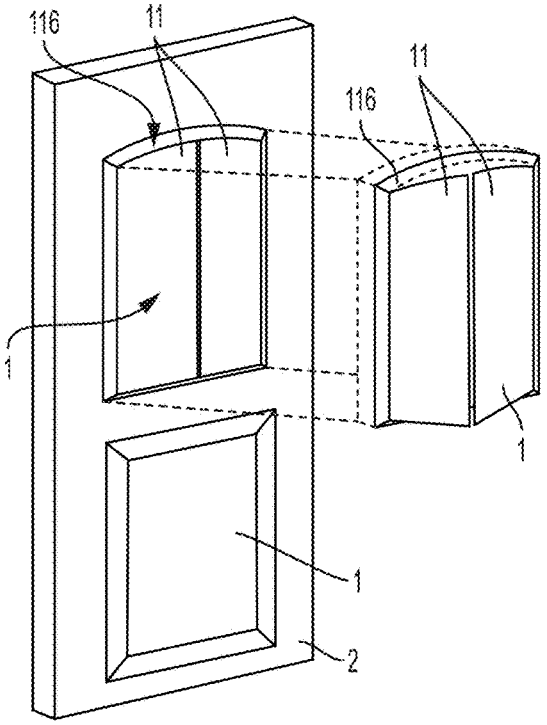
FIG. 2 is a perspective view of an embodiment of the door of the disclosed technology, with modular inserts installed and, with dashed lines, showing removal thereof.
Figure 3:
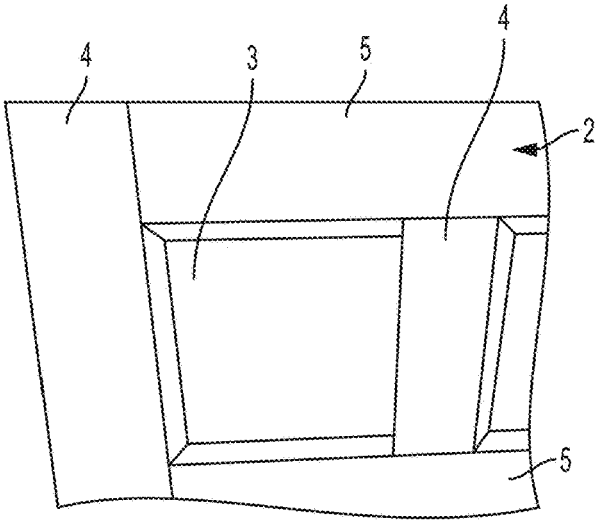
FIG. 3 is a perspective view of an embodiment of the cavity of the door of the disclosed technology.
Figure 12:
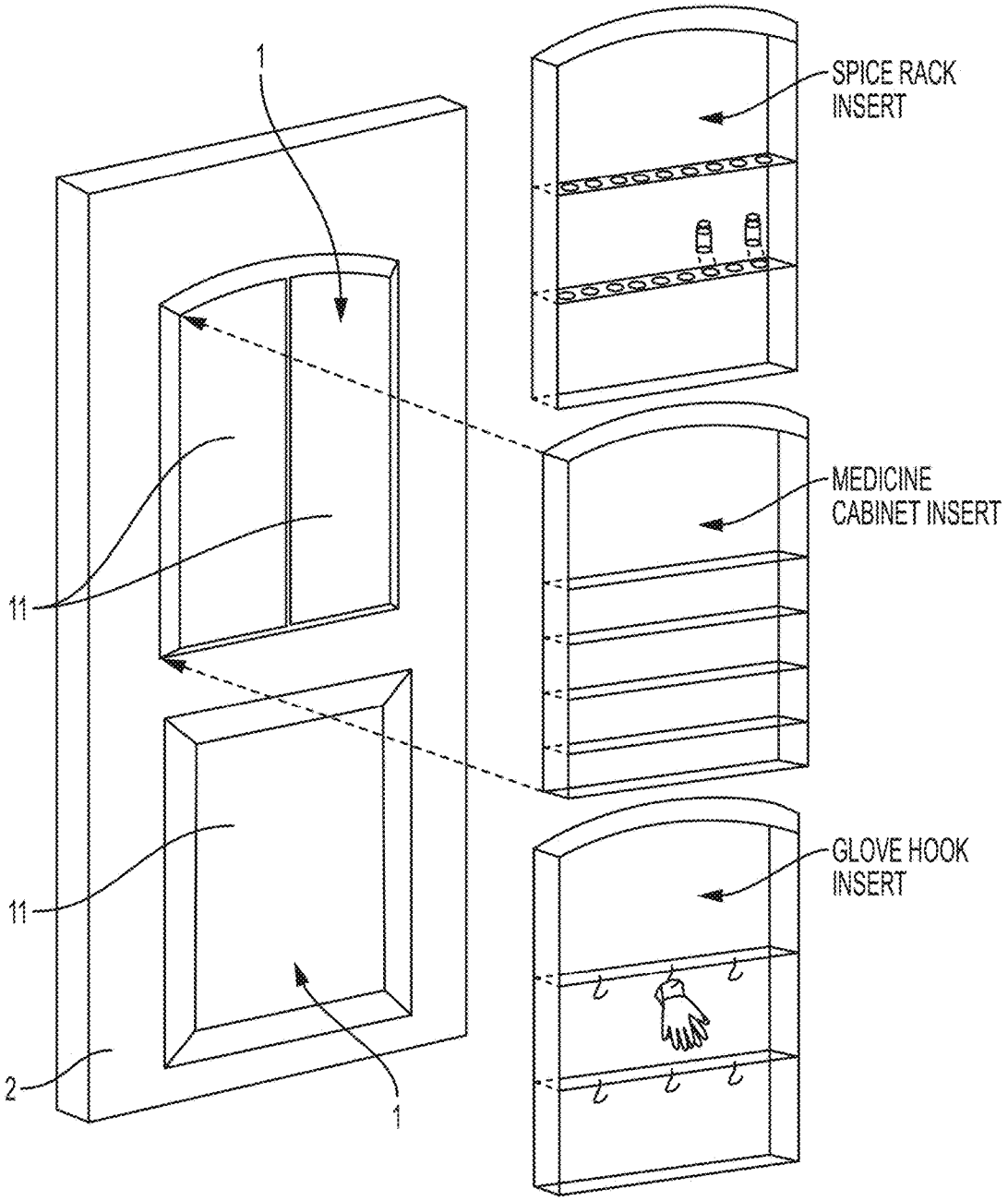
FIG. 12 is a perspective view of an embodiment of the door and the modular insert of the disclosed technology, with alternative support structures shown by dashed lines.
Figure 13:
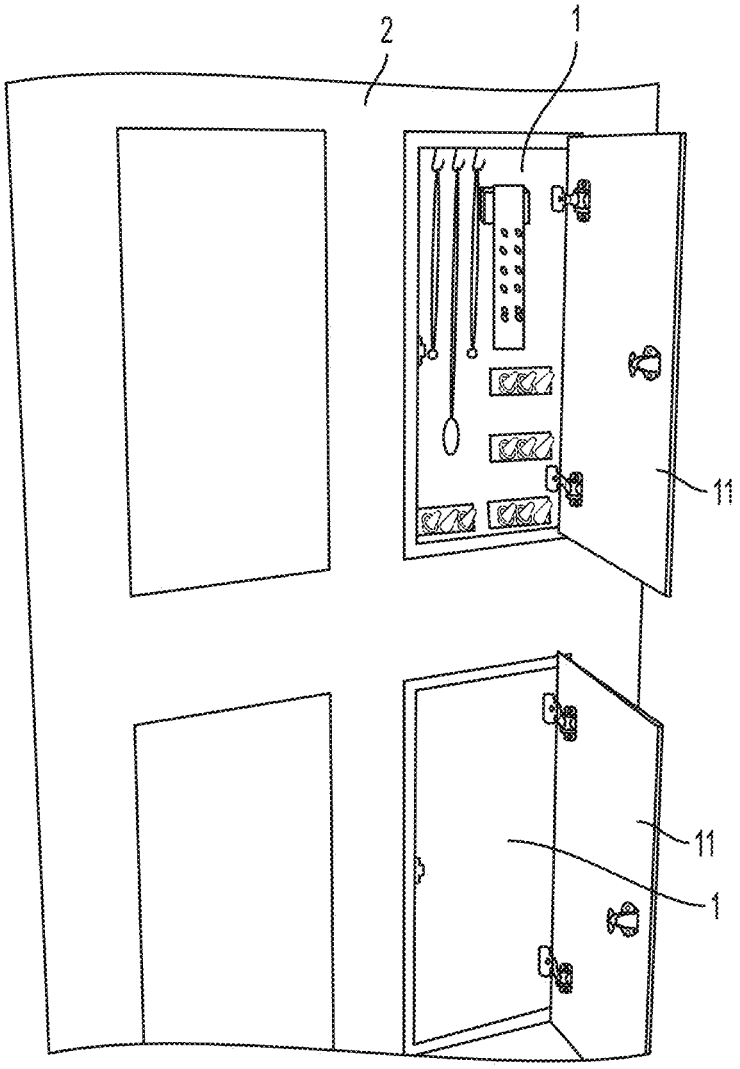
FIG. 13 is a front view of an embodiment of the door and modular inserts of the disclosed technology.
Figure 15:
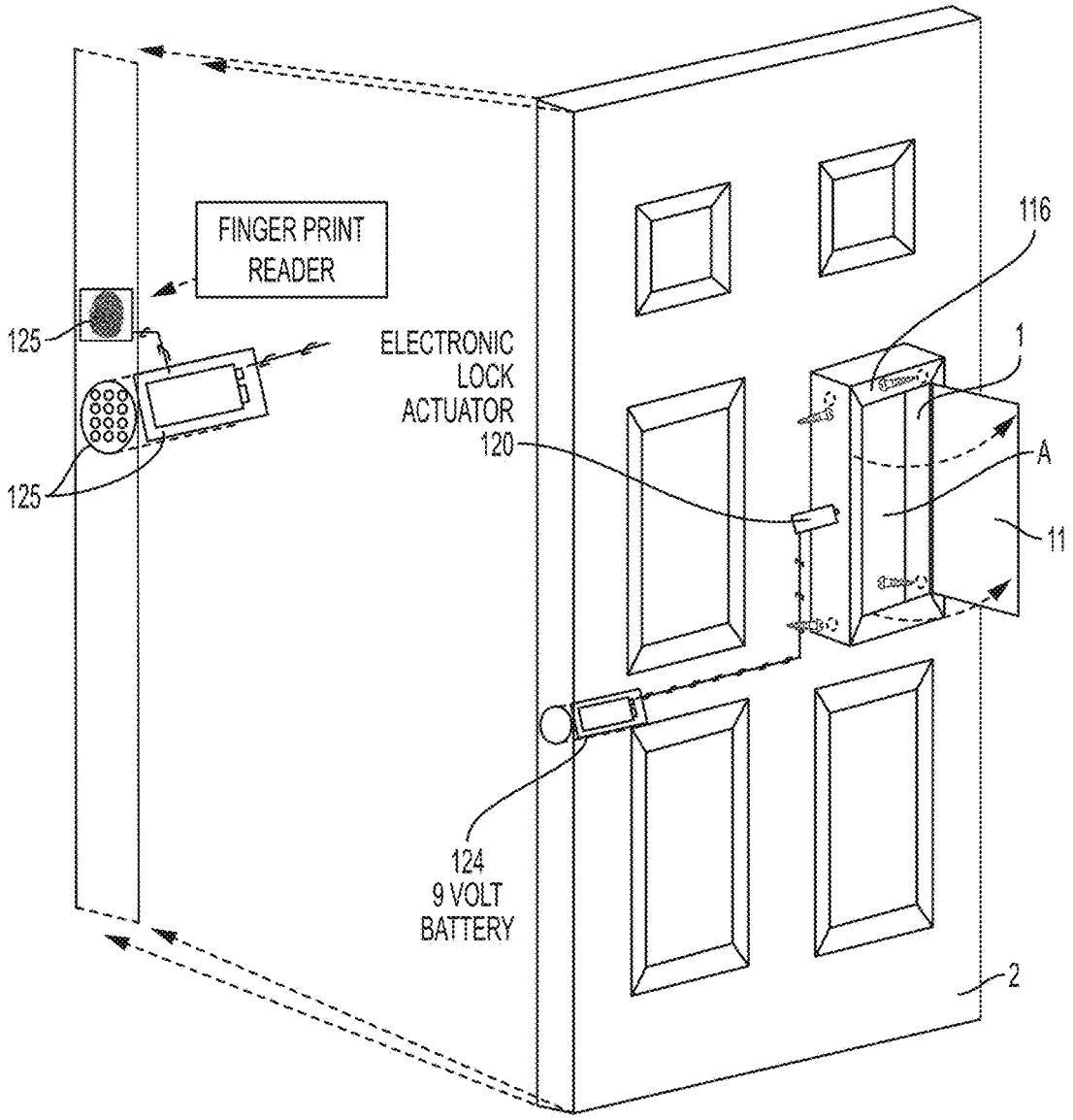
FIG. 15 is a perspective view of an embodiment of the door and the modular insert of the disclosed technology, having at the cutout a fingerprint reader and a keypad, controlling an actuator locking at least one of the modular inserts.

In another embodiment, shown in FIGS. 2 and 12, two top panels 11 are hingedly secured on opposing sides of the frame. Further, in these and other embodiments (including those described above), each of the frame walls may include a frame segment 116, extending from a front face of each wall into the vacuous area formed by the frame walls, as depicted in FIGS. 2 and 15. In these embodiments, the top panel(s) is(are) hingedly affixed to one of the frame segments (rather than directly to the interior of the wall, as with the prior embodiments).

Figure 7:
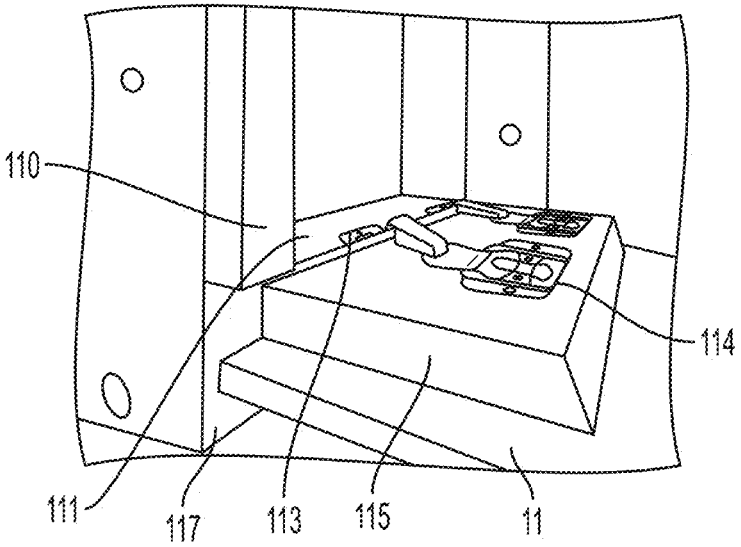
FIG. 7 is a perspective view of portions of embodiments of the top panel and the frame of the modular insert of FIG. 6.
Figure 8:
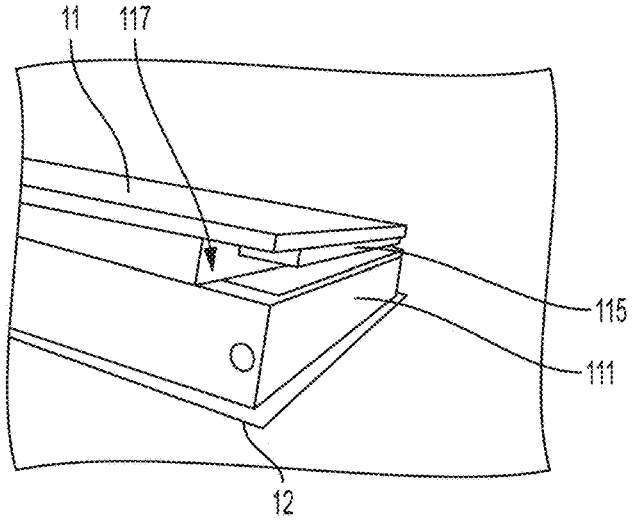
FIG. 8 is a perspective view of an embodiment of the modular insert of FIG. 6, with the top panel closed.
Figure 9:
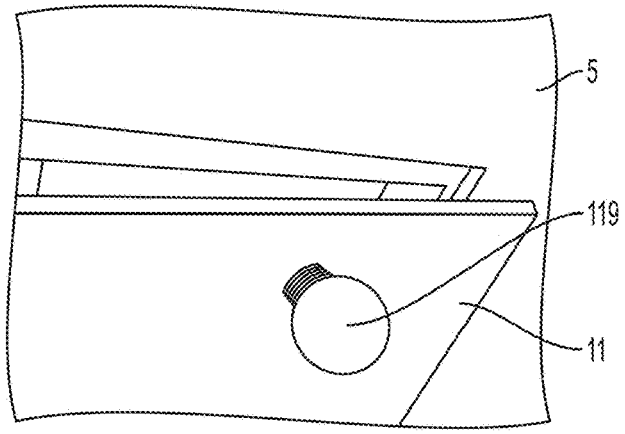
FIG. 9 is a front view of the embodiment of the modular insert of FIG. 6, with the magnet pull engaged with the magnet, facilitating opening of the top panel relative to the frame.
Figure 10:
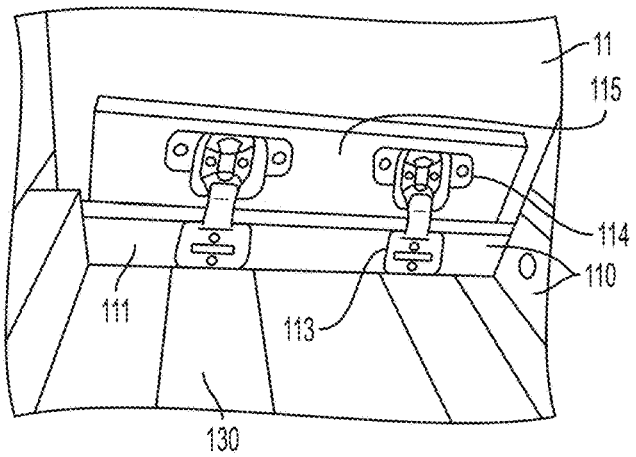
FIG. 10 is a perspective view of a portion of an embodiment of the modular insert of FIG. 6, with the top panel in the open position.

In the embodiments shown in FIGS. 7 and 8, the frame includes a recess 117 along the length of the first side 111 (the side that the top panel is hinged to) to facilitate opening of the top panel when installed in the frame.

To further facilitate opening the top panel, a pull may be secured to the exterior surface of the panel. However, because the pull may interfere with use of the door, in the embodiments shown a magnet 118 is secured on an interior surface of the top panel (see, e.g, FIG. 6). Suitable magnets have sufficient magnetic field to attract and removably secure a magnet knob 119 when removably positioned on an exterior surface of the top panel positioned near the position of the secured magnet (see, e.g., FIG. 9), thereby providing force against, for example, the force of the spring hinge, to allow the top panel to be opened (wherein the spring hinge otherwise secures the top panel in a closed position relative to the frame). Alternative embodiments hold the top panel closed relative to the frame, and facilitate the opening thereof, by means of a magnetic spring latch or magnetic catch.

Figure 11:
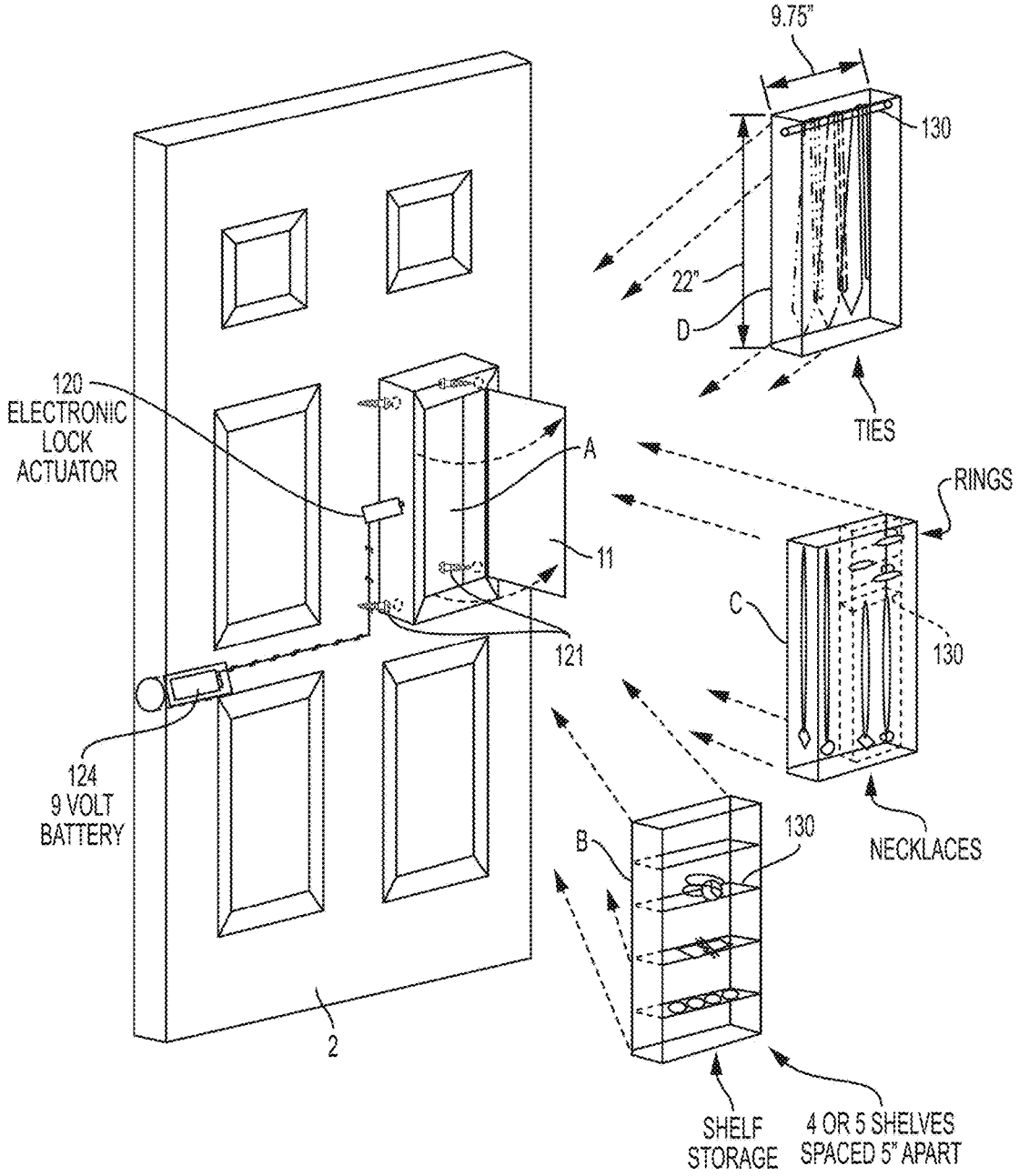
FIG. 11 is a perspective view of an embodiment of the door and the modular insert of the disclosed technology, with alternative support structures shown by dashed lines.
Figure 14:
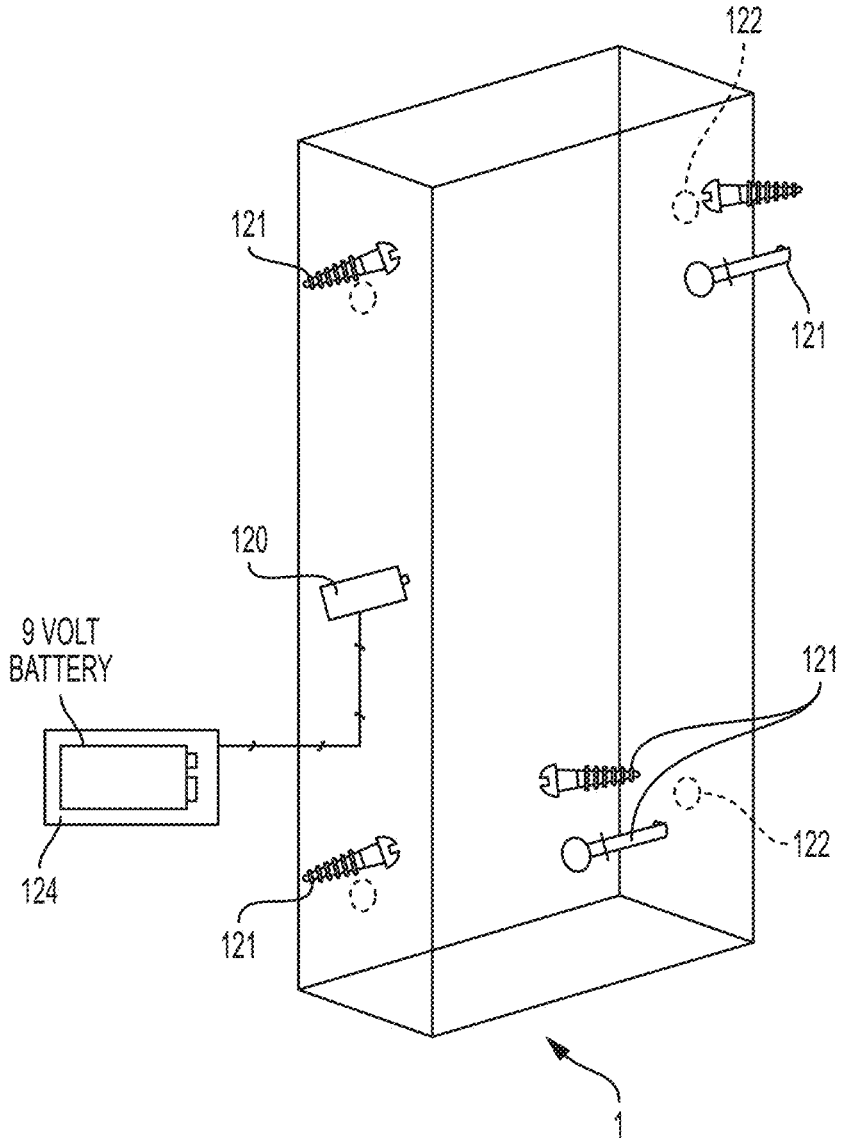
FIG. 14 is a perspective view of an embodiment of a modular insert of the disclosed technology, with various affixation means and a locking mechanism.
Figure 16:
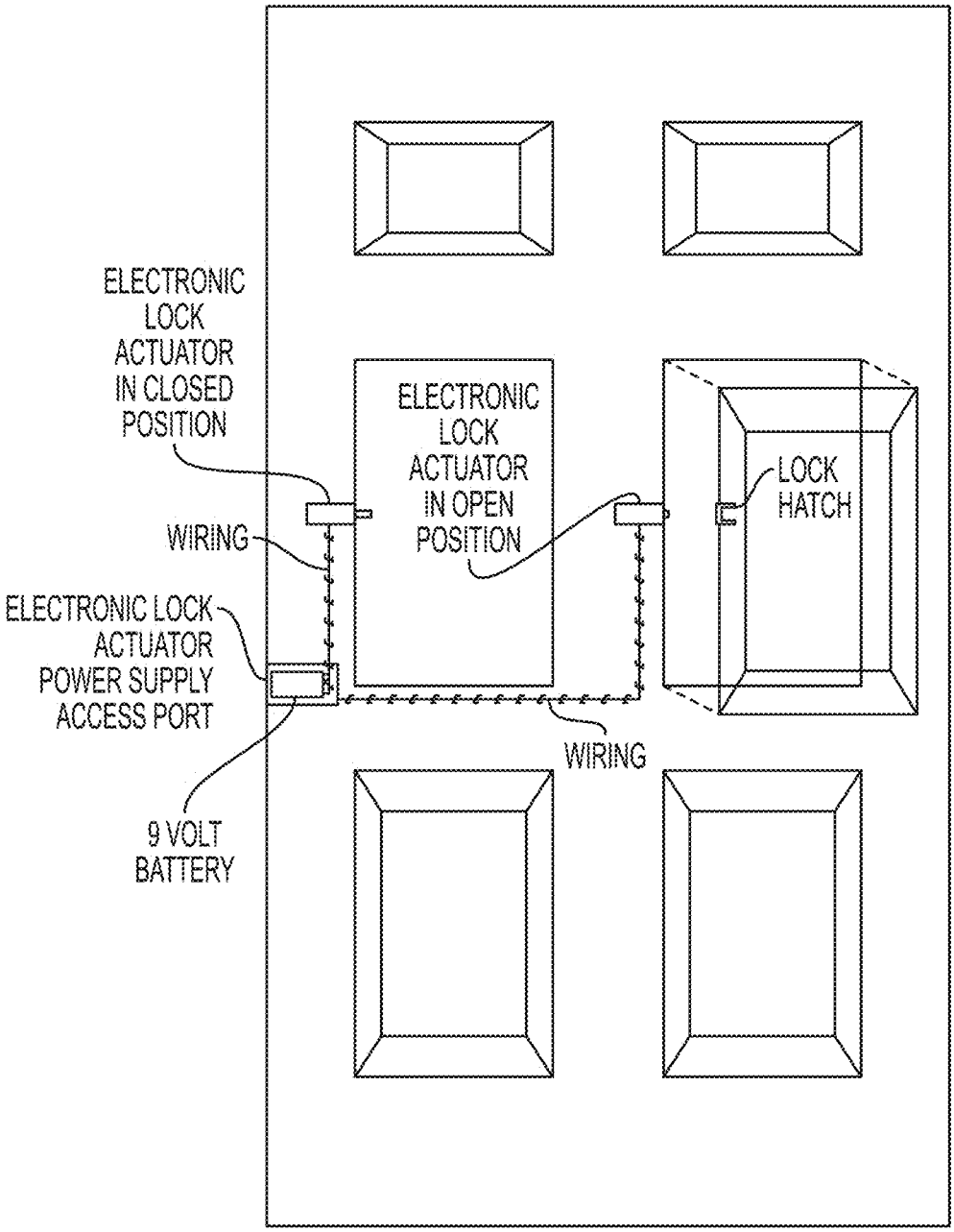
FIG. 16 is a perspective view of an embodiment of the door, having modular inserts which are locked and unlocked by means of an actuator.

In other embodiments, as shown for example in FIGS. 11, 14 and 15, an actuator 120 may be used to lock the top panel to the frame, such as by means of a power actuator affixed within a stile or rail, or within a modular insert, having a locking mechanism engaged with the top panel to lock the panel until the actuator releases the locking mechanism. In this embodiment, power may be provided to the actuator by means of a power supply, for example, a 9 volt battery 124 removably secured within the rails and stiles, as shown in FIG. 16. Wires associated with this configuration, between the power supply and the actuator, may be supplied through grooves provided within adjoining stiles or rails to accommodate the wire. The wiring can be run through the rail and stile in assembly of the door, with a connection point at the frame when the modular insert is inset in the door. For example, a hole may line up to the connection port in the door frame and the two connectors can be snapped together. In another embodiment, the base panel is attached to the door frame and the top panel is attached to the frame, the locking mechanism may be attached to the door frame and the catch, catch hook or catch plate will be attached to the panel door. The modular insert can be molded to fit around the locking mechanism.

In some embodiments, a battery holder may be installed into the outer edge of the door frame, with a removable cover plate that allows access to the battery holding area. The cover plate may be removable by way of two bolts or screws that pass through the cover plate and attach to the battery holder that is installed in the door frame. The cover plate may or may not have a spring or similar device attached to it on the inside to firmly hold the battery or battery holder in place. In this embodiment the battery may be a 9 volt snap connector with wire leads that are of sufficient length to be pulled out of the battery holder area and the re-inserted once the battery is snapped into the snap connector. Another embodiment may include a battery holder for multiple AA or A batteries that fit into the holder, wherein the holder is slid into the battery storage area of the door frame. In this embodiment the battery holder will have metal contact points that once slid into the storage area will come in contact with a connection point that is attached to the wires that go to the lock solenoids.

The position of the actuator between a locked and unlocked position may be controlled by means of a remote control, using known technologies. Alternatively, as shown in FIG. 15, the actuator may be controlled by means of known technologies including key pads, radio frequency identification using radio waves to identify people or objects carrying encoded microchips (RFID), gesture recognition, biometric recognition, and fingerprint recognition, and alternative combinations thereof.

As shown in the embodiments of FIGS. 11 and 14, the insert may be removably secured to the door, in the cavities, by fastening means 121 such as, for example, screws, bolts, quick release or push-pull pins and wing nuts, wherein the fastening means are received in apertures 122 on opposing sides of the frame. Although all of these fastening means allow for the removability of the insert, the use of wing nuts or quick release/push-pull pins may provide for tool-less, easy removal thereof. The apertures may comprise a threaded insert nut, or a nut with an aperture to receive a pin of a push-pull pin, or similar structure to allow the insert to be secured in the aperture by means of the fastener, but quickly released therefrom to remove the affixation means (and the modular insert from the door).

As hereinabove discussed, the modular insert is useful for storing one or more objects. Although the vacuous area 123 within the frame provides a good storage compartment for many objects, a support structure 130 may be affixed to the frame or base panel (if present), designed and configured to support one or more of the objects in the modular insert. For example, as shown in FIGS. 11 and 12, one or more shelves or storage compartments may be affixed to the interior surface of the base panel or the frame (or both) to support many types of objects. Apertures within such shelves may support multiple units of similar size, such as spice jars. These structures or the frame may support a plurality of hooks, as shown in FIGS. 6, and 11-13; alternatively, one or more hooks may be affixed to the frame or the base panel, useful to store jewelry and other hangable items. As depicted in FIG. 11, the support structure may also be configured as an adornment holder, affixed to the back wall or the frame, with apertures for example to support earrings or other similar items. Other support structures may include mirrors, shelves, and/or storage compartments so that the support structure can be used as a cosmetics station. To be useful to store ties or other similar items, the support structure may include a rod or a tie rack (see, e.g., FIG. 11). Other support structures may be used to store, for example, documents.

As shown in FIGS. 1-4, 11-13, and 15, the disclosed technology further regards a door 2 suitable for removably mounting one or more modular inserts 1, the door comprising a plurality of rails 5 and stiles 4, wherein the stiles and rails form one or more cavities 3. In some embodiments the door has a back panel; in other embodiments, the cavities create a void through the entire door.

Figure 4:
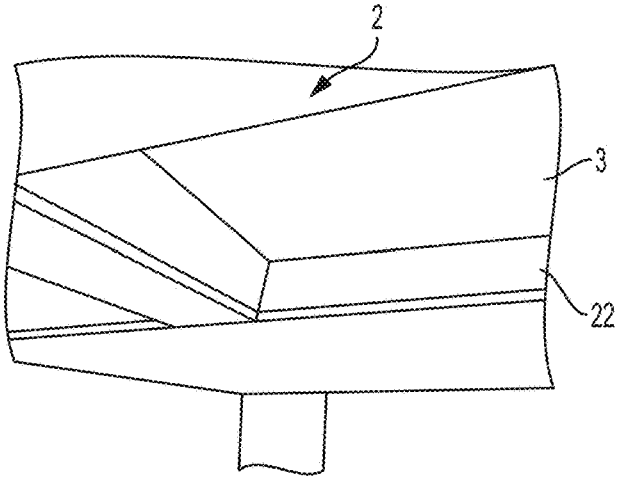
FIG. 4 is a perspective view of another embodiment of the cavity of the door of the disclosed technology.
Figure 5:
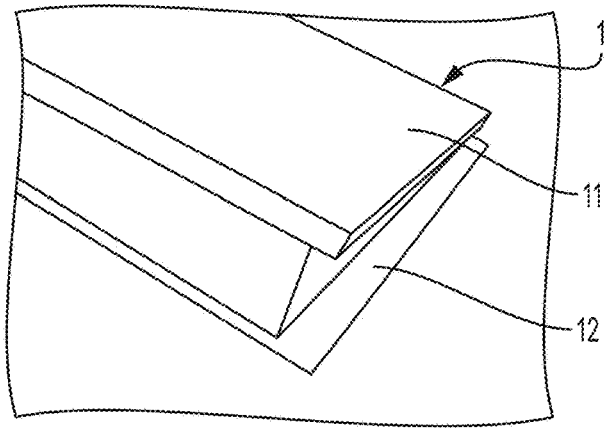
FIG. 5 is a partial view of embodiments of the door, and the modular insert partially inset within the door, of the disclosed technology, being received within a cavity of the door.
Figure 6:
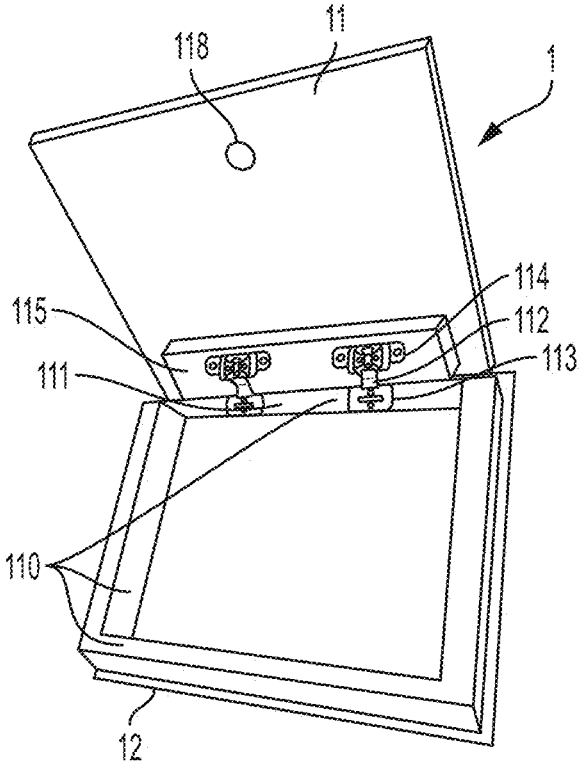
FIG. 6 is a perspective view of an embodiment of the modular insert of the disclosed technology.

In some embodiments, as shown in FIGS. 4 and 5, the cavities of the door have an internal frame affixed to the stiles and rails. This internal frame has a depth less than the depth of the stiles and rails, the reduction in depth being at least equal to a thickness of the top panel of the modular insert. By this configuration the top panel rests flush with the surface of the stiles and rails, when the modular insert is positioned within a door cavity.

Figure 17:
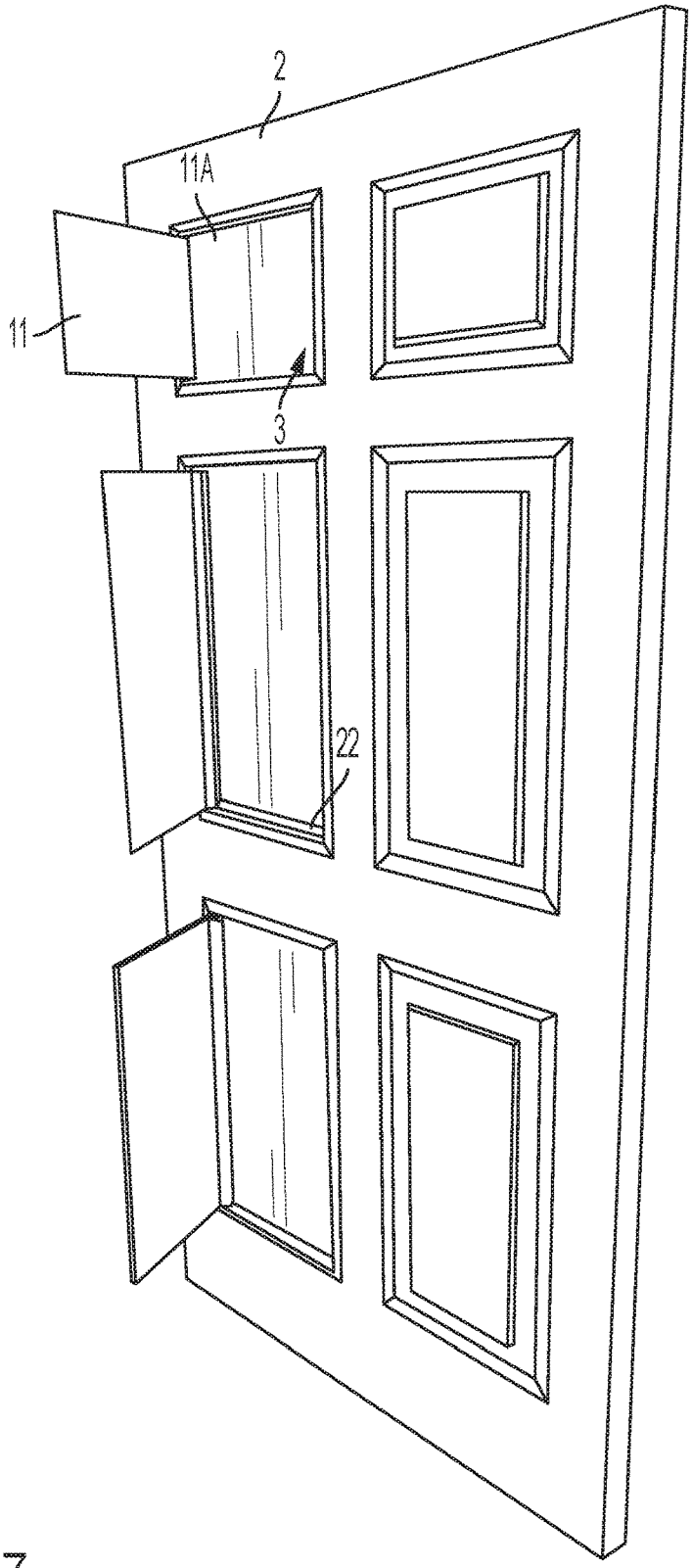
FIG. 17 is a perspective view of another embodiment of a door of the disclosed technology, before the modular inserts are received in the cavities thereof.
Figure 18:
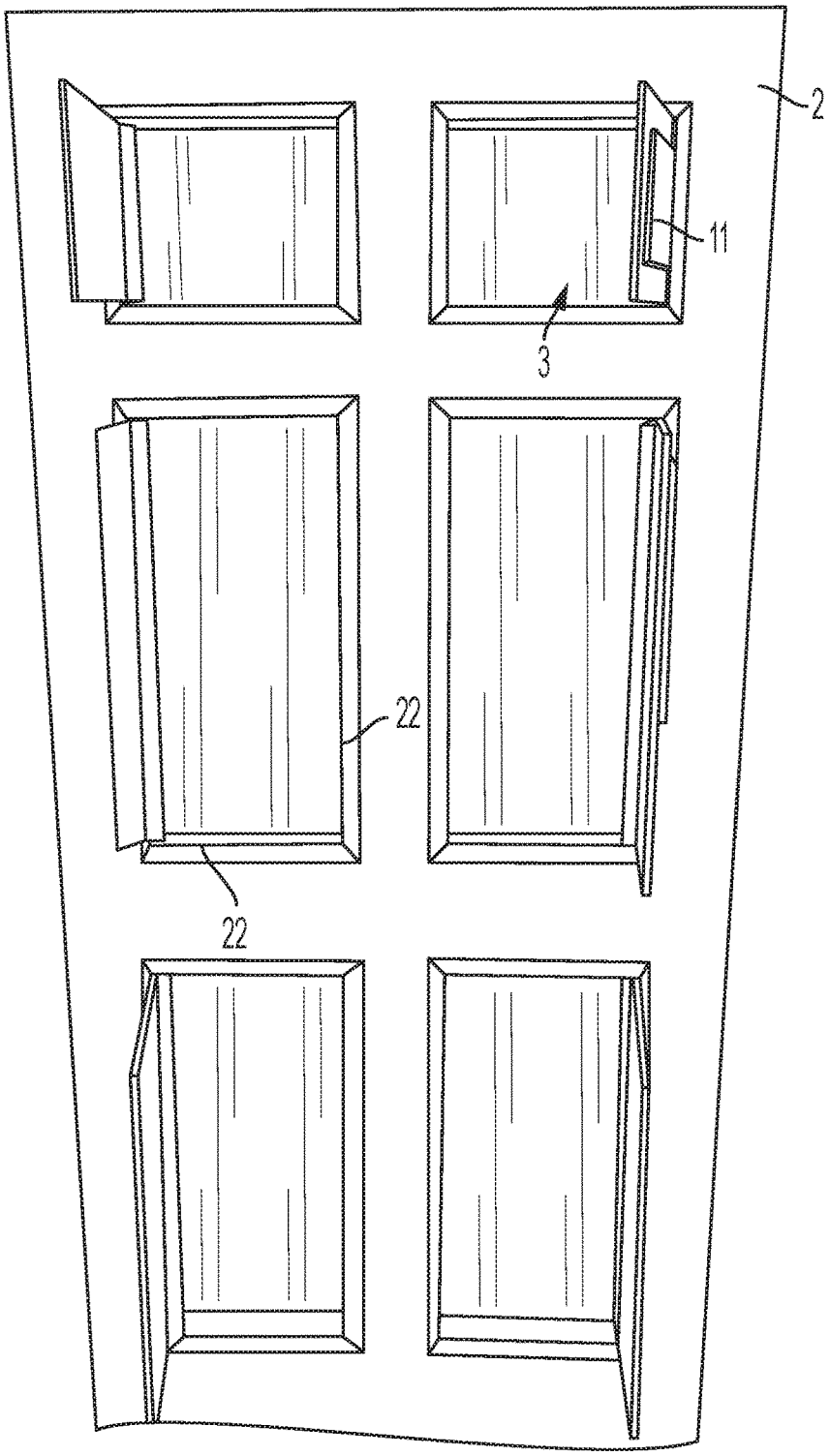
FIG. 18 is a front view of the embodiment of a door of FIG. 17.
Figure 19:
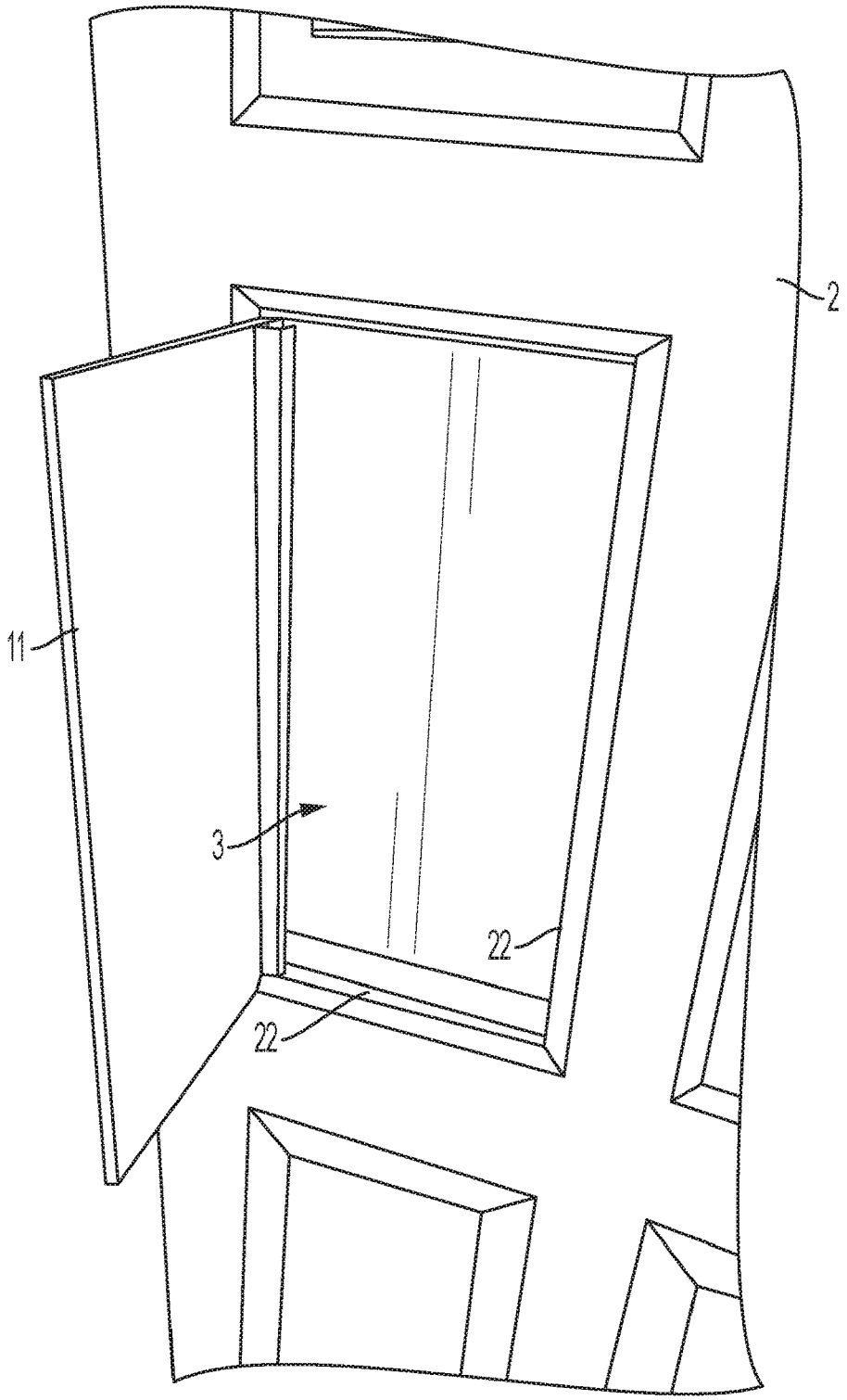
FIG. 19 is a perspective view a portion of the door of FIG. 17.
Figure 20:
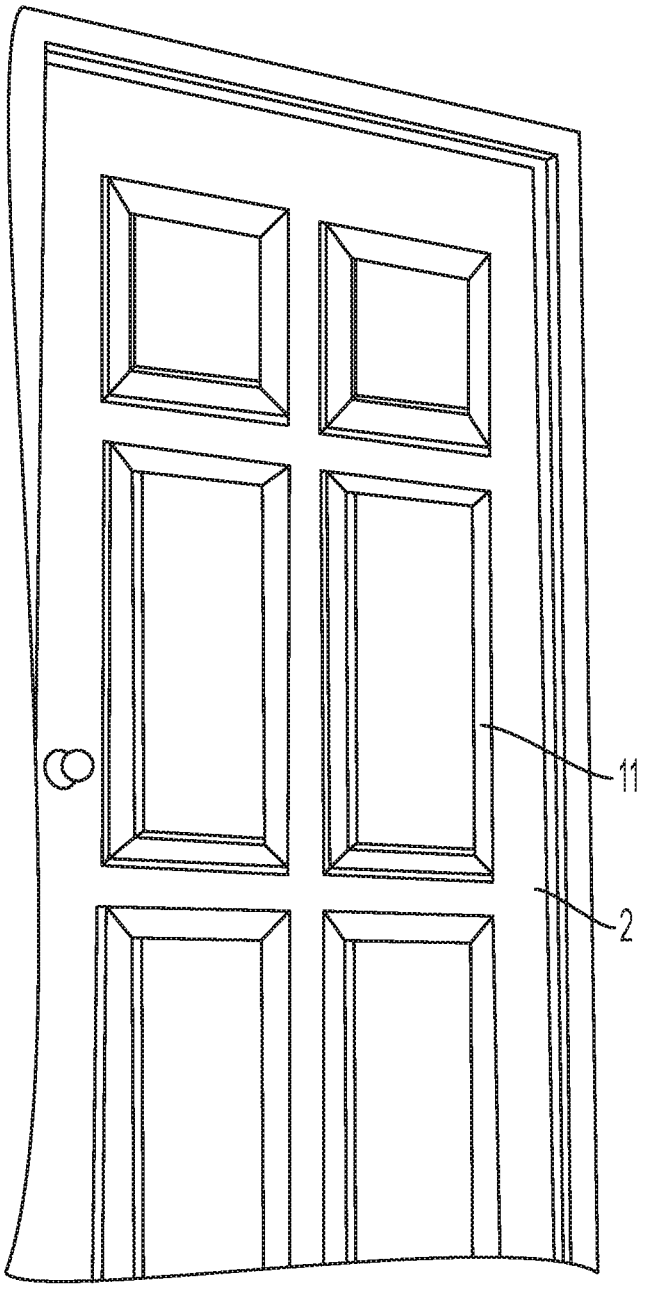
FIG. 20 is a perspective view of another embodiment of a door of the disclosed technology, with the doors of the cavities closed.
Figure 21:
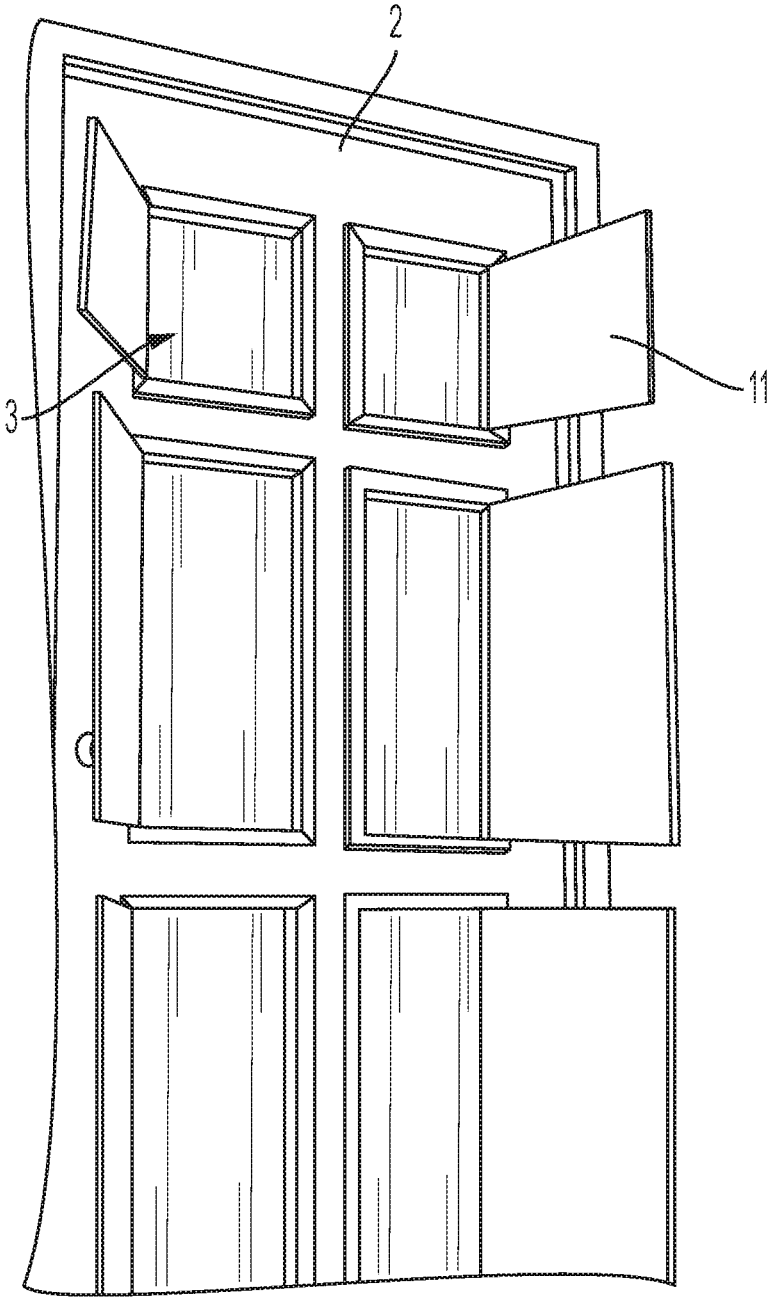
FIG. 21 is a perspective view of the embodiment of the door of FIG. 20, with the doors of the cavities opened.
Figure 22:
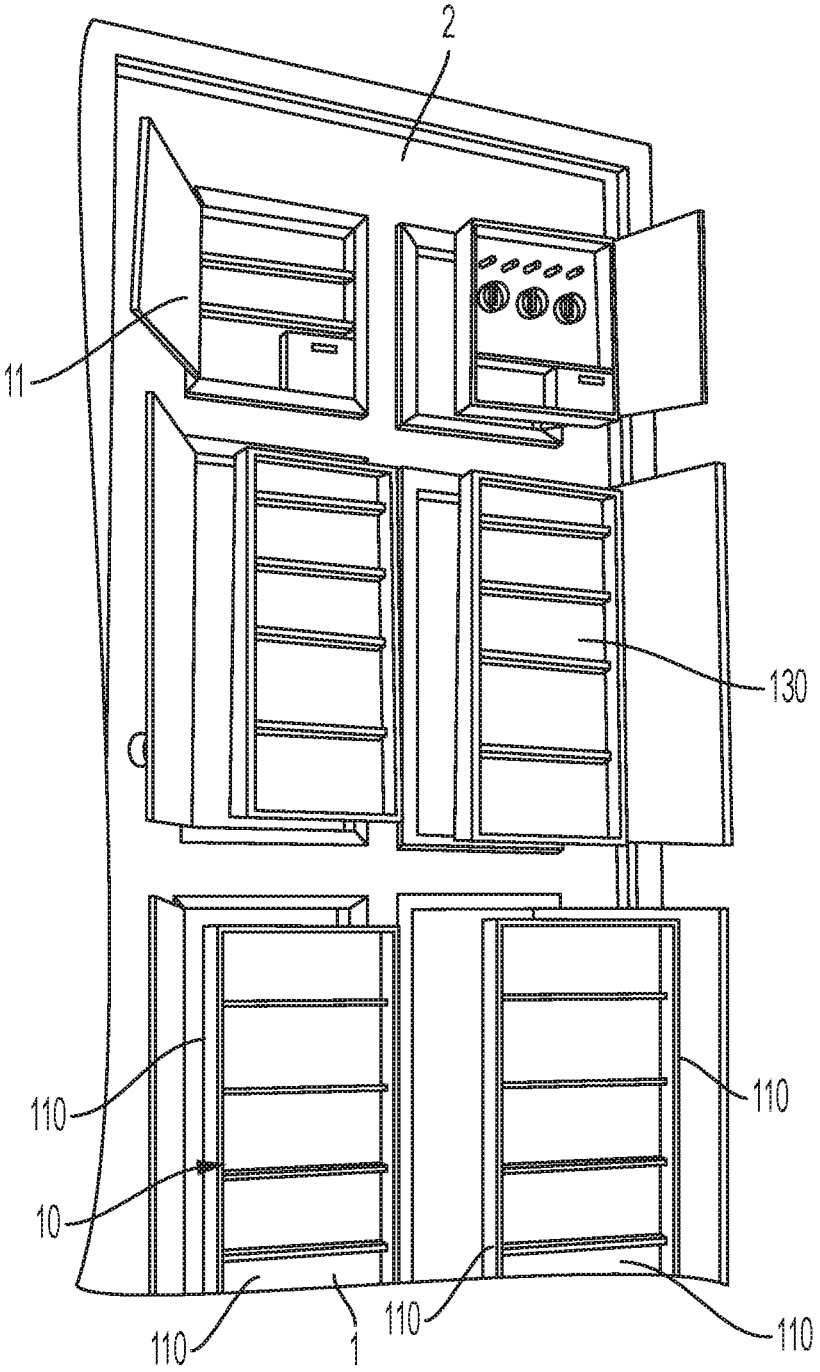
FIG. 22 is a perspective view of the embodiment of the door of FIG. 20, with the modular inserts shown.
Figure 23:
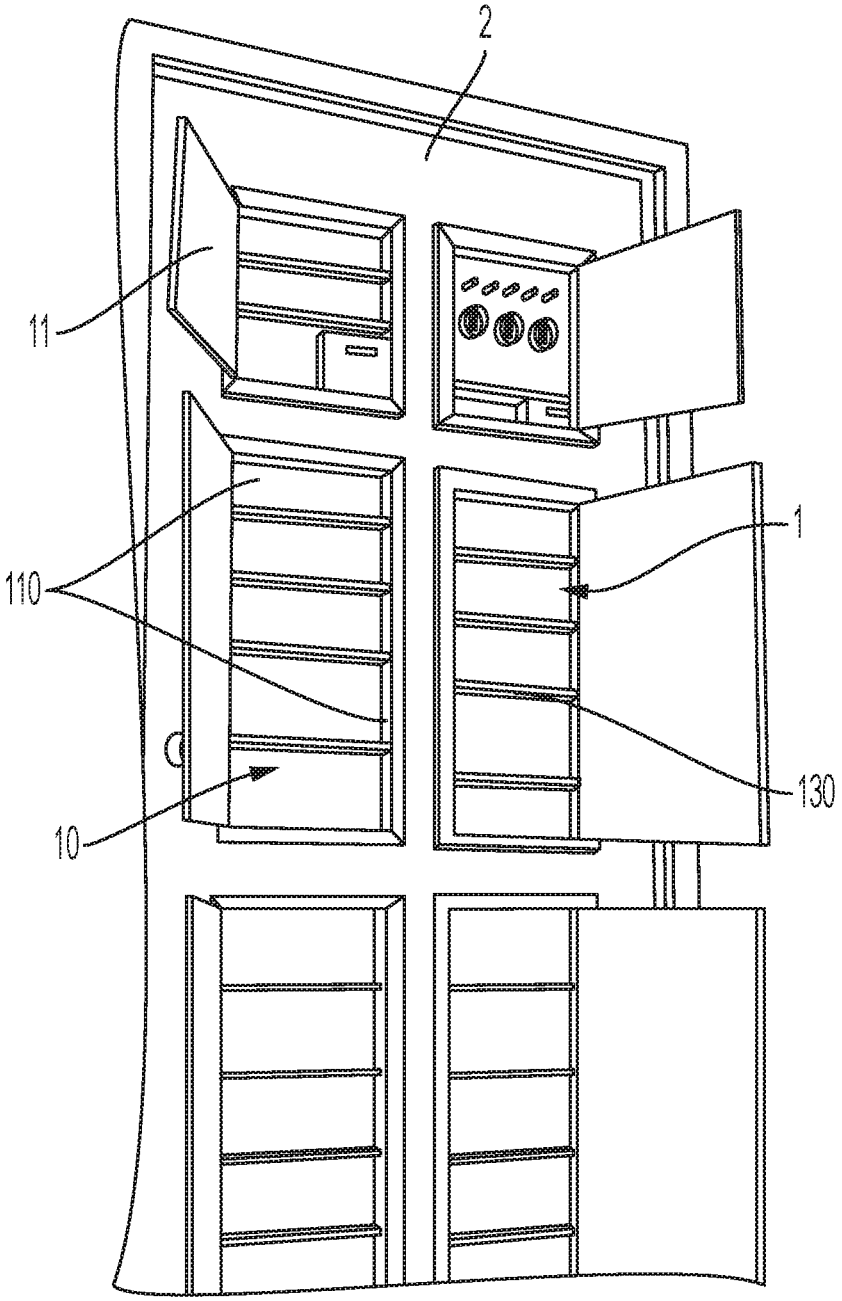
FIG. 23 is a perspective view of the embodiment of the door of FIG. 20, with the modular inserts installed in the cavities of the door, and the cavity doors open.

In another embodiment, as shown in FIGS. 17-24, the top panels 11 are hingedly affixed to the door 2 rather than to the modular inserts, wherein each top panel 11 is movable between an open and a closed position. As shown in FIG. 17, the top panel 11 is affixed to a side wall of the cavity 3 within the front panel of the door (the back of the cavity being the back panel of the door). In this embodiment, the cavity has at least one interior side wall 11A to which the top panel 11 is hingedly affixed. As shown in FIG. 25, the top panel 11 may be hingedly affixed to the side wall 11A by means of a continuous or piano hinge 11B, alternatively the top panel may be hingedly secured to the side wall by means of a concealed hinge, such as TECTUS® manufactured by Simonswerk, or SOSS invisible hinges. Other hinging mechanisms as hereinabove described may be used in this embodiment to hingedly secure the top panel to the interior wall of the cavity of the front panel of the door. At least a portion of the side wall 11A has a reduced depth compared to the depth of the cavity, wherein the reduction in depth is no less than the thickness of the top panel so that when the top panel is closed, it sits flush or coplanar with the exterior surface (front panel) of the door (disregarding any decorative elements on the door).

In these and other embodiments, the cavity may have an internal frame 22, including interior side wall 11A, affixed to the door. In some embodiments, the top panel is sized larger (about ¼" to 1") in length and width as compared to the dimensions of the internal frame, and/or the dimensions of the modular insert. The back of the door 2 may be solid, with one or more back panels, with or without decorative elements, which may but does not necessarily form the back enclosure of the cavities.

Figure 24:
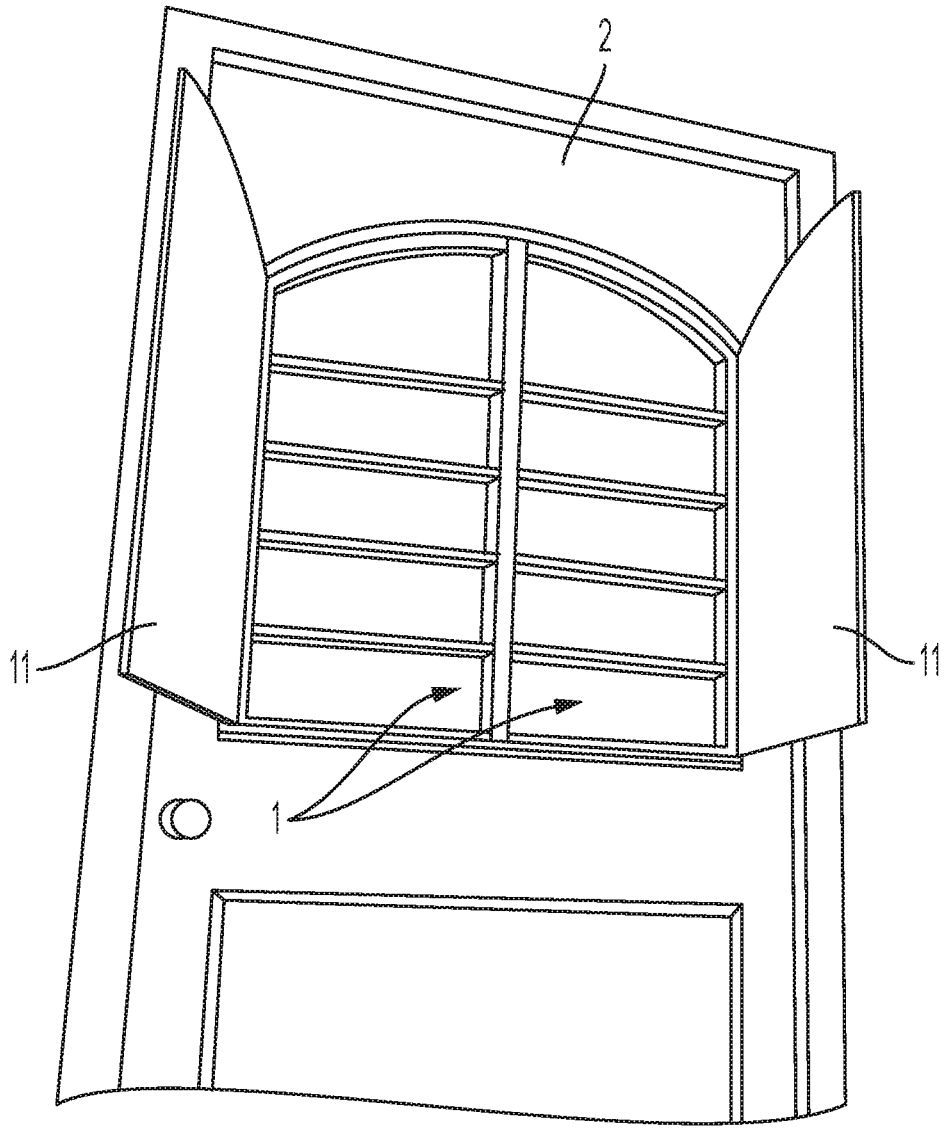
FIG. 24 is a perspective view of another embodiment of a door of the disclosed technology, with the modular inserts installed in the cavities of the door, and the cavity doors open.
Figure 25:
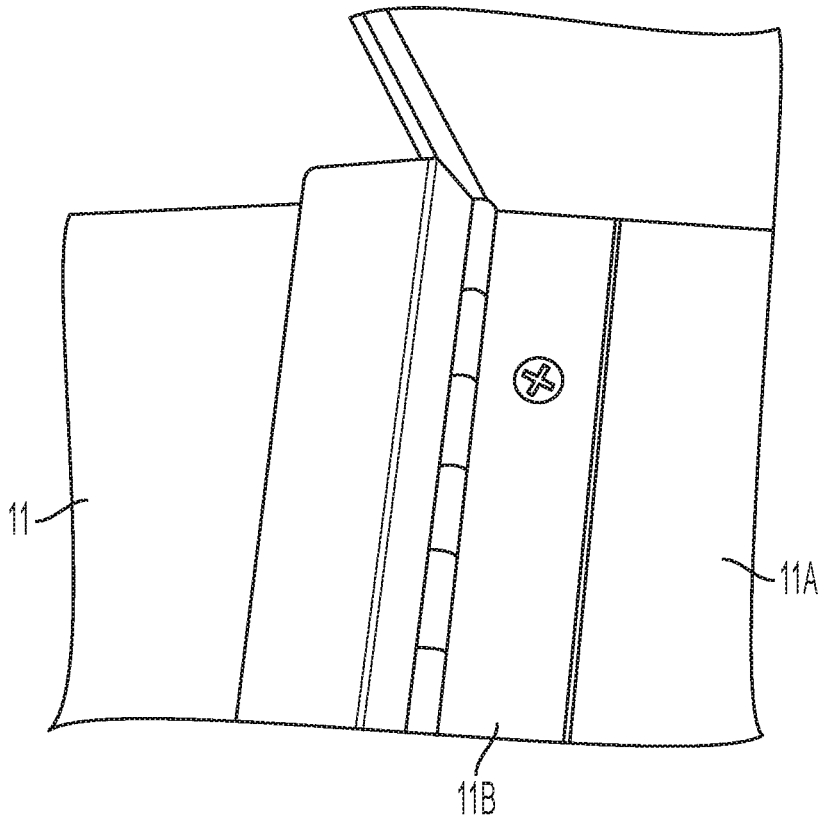
FIG. 25 is a perspective view of an example of a hinged affixation of the top panel to the interior side wall of the cavity.

As shown in FIG. 24, in this embodiment, the top panel may include two panels, wherein one panel is hingedly secured to one interior wall of the cavity, and the second is hingedly secured to an opposing interior wall of the cavity.

In this embodiment, the modular insert 1 includes a frame 10 having a plurality of walls 110 forming a plurality of sides of the frame, and a back panel. The insert may be removably secured to the door, within the cavity, with fastening means as hereinabove described for other embodiments of the modular insert; alternatively, it may be sized and configured so that it has a snug fit within the door cavity, thereby allowing it to be removed with sufficient force. The modular inserts may include support structures 130, such as those otherwise herein disclosed, which may affixed to a wall or a back panel of the insert.

The top panel may be secured in its closed position relative to the cavity, by securing means as hereinabove described in other embodiments, and openable by means of a pull, magnets/magnet knobs, spring hinges, magnetic spring latches or magnetic catches, as hereinabove described.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination, and aspects of embodiments described herein may be applicable to and can be used on other embodiments of the disclosed technology. It is therefore intended that the appended claims cover all such changes and modifications that are within the scope of the claimed subject matter.

The invention claimed is:

1. A door storage system useful for storing one or more objects within a door, the door comprising a front panel, a back panel, and means to hingedly affix the door to a door frame, wherein a plurality of cavities extend from the front panel through the depth of the door to the back panel, each cavity having an interior wall to which a top panel is hingedly affixed, the top panel moving between an open and a closed position, and when in the closed position is coplanar with the front panel of the door, wherein each cavity further comprises an internal frame affixed to the door and forming the cavity, the internal frame having a depth less than the depth of the cavity, the reduction in depth being at least equal to a thickness of the corresponding top panel, and wherein each of the cavities is sized to receive a modular insert, the modular insert comprising a frame having a plurality of walls and a back panel, forming a plurality of sides and the back of the frame.

2. The door storage system of claim 1, wherein an exterior surface of the top panel is made from the same material as the front panel of the door.

3. The door storage system of claim 1, wherein the top panel is hingedly affixed to the interior wall of the cavity by means of a piano hinge.

4. The door storage system of claim 1, wherein the top panel is hingedly affixed to the interior wall of the cavity by means of a concealed hinge.

5. The door storage system of claim 1, wherein each top panel has a length and width greater than a length and width of the modular insert to be received in the cavity to which the top panel is affixed.

6. The door storage system of claim 1, wherein the top panel comprises first and second panels, with the first panel hingedly secured to one interior wall of the cavity, and the second panel is hingedly secured an opposing interior wall of the cavity.

7. The door storage system of claim 1, further comprising securing means to removably secure the top panel in a closed position relative to the frame.

8. The door storage system of claim 7, wherein the securing means is an actuator affixed to a wall of the frame, and wherein the actuator is electrically engaged with a power supply embedded within and accessible from the exterior of the door.

9. The door storage system of claim 8, wherein the position of the actuator between a locked position and an unlocked position is controlled with a remote control.

10. The door storage system of claim 7, wherein the securing means further comprises recognition means for recognizing a user, the recognition means being engaged with and determining the position of an actuator, the recognition means selected from the group consisting of: radio frequency identification using radio waves to identify encoded microchips (RFID), gesture recognition, biometric recognition and fingerprint recognition.

11. The door storage system of claim 1, further comprising a support structure affixed within the modular insert, the support structure designed and configured to support one or more objects in the modular insert.

12. A door storage system useful for storing one or more objects, the door being intended for hinged affixation to a door frame, the door storage system comprising:

a plurality of cavities on a first side of the door;

one or more back panels forming a second side of the door, the back panels covering an end of each of the cavities;

a plurality of top panels hingedly affixed to the first side of the door, each top panel concealing a cavity and being coplanar with the first side of the door when the top panel is closed; and one or more modular inserts, each modular insert being sized and configured to be received within one of the cavities of the door, the modular inserts comprising a frame having a plurality of walls forming a plurality of sides of the frame;

wherein each cavity comprises an internal frame affixed to the door and forming the cavity, the internal frame having a depth less than the depth of the cavity, the reduction in depth being at least equal to a thickness of the top panel.

13. The door storage system of claim 12, wherein the support structure is selected from the group consisting of: shelves, hooks, adornment holders, individual storage compartment, rods, and tie racks.

14. The door storage system of claim 12, wherein the top panel has a length and width greater than the length and width of the modular insert.

15. The door storage system of claim 12, further comprising a support structure affixed within the modular insert, the support structure designed and configured to support one or more objects in the modular insert, wherein the support structure is selected from the group consisting of: shelves, hooks, adornment holders, individual storage compartment, rods, and tie racks.

* * * * *